US005934219A

United States Patent [19]

Poiraud

[11] Patent Number: 5,934,219

[45] Date of Patent: Aug. 10, 1999

[54] SPEARHEAD ANCHOR

[76] Inventor: Alain A. Poiraud, Hylas-B.P. 212 Eragny, Cergy Cedex, France, 95614

[21] Appl. No.: 08/875,536

[22] PCT Filed: Jan. 11, 1996

[86] PCT No.: PCT/FR96/00049

§ 371 Date: Jul. 15, 1997

§ 102(e) Date: Jul. 15, 1997

[87] PCT Pub. No.: WO96/22218

PCT Pub. Date: Jul. 25, 1996

[30] Foreign Application Priority Data

Jan. 16, 1995 [FR] France ..... 95 00487

[51] Int. Cl.[6] ..... B63B 21/38

[52] U.S. Cl. ..... 114/301; 114/294

[58] Field of Search ..... 114/294, 301–304

[56] References Cited

U.S. PATENT DOCUMENTS 5,188,055 2/1993 Kershner ..... 114/301

5,474,015 12/1995 Bruce ..... 114/301

*Primary Examiner*—Ed L. Swinehart

[57] ABSTRACT

A marine anchor designed so that it positions itself automatically and penetrates instantly into all kinds of sea beds with maximum holding power. The geometry and ballasting of the anchor ensure automatic positioning of the anchor. The off-center position of the ballast counter-balancing the weight of the shank places the center of gravity of the anchor as close as possible to the anchor tip, so that the tip can bear practically half the total weight of the anchor, the pressure exerted by the top on the sea bed is increased, and its penetration into the sea bed is promoted. The sharp corners between the two sides of the tip aids penetration into all kind of sea beds, including sea beds covered with thick seaweed, and the concave surface of the fluke provides maximum holding power. Said anchor is suitable for mooring yachts and fishing boats, as well as for marine industrial use.

6 Claims, 2 Drawing Sheets

CROSS SECTION A A'

FIG. 5 - CROSS SECTION A A'

CROSS SECTION
B B'

CROSS SECTION C C'

SPEARHEAD ANCHOR

Cross References to Related Application: French Patent No. 27 29 36

Tunisia No. SN 96 136

OEB No. 9690/380.4-2312

NZ No. 300632

AU No. PCT-FR 96/0049

Statement as to rights to inventions made under Federally-sponsored research and development:

No Federally-sponsored research has been involved with this invention.

BACKGROUND OF THE INVENTION

1. Field of the Invention

The anchor described is used to secure any type of vessel in harbours or anchorages.

2. Description of the Prior Art

Since ancient times, man has needed to anchor boats, this was first achieved by means of casting overboard heavy stones attached to the ship by a rope. Over a time, more sophisticated anchors made of iron or wood and ballasted with lead were developed. The traditional marine symbol, the fisherman anchor, is virtually no longer used today, due to it's heavy weight, it's dimensions and it's poor performance.

The common modern anchors, although offering an improvement of anchoring performances, have the disadvantage of not being well adapted to all types of sea bed and not giving a high holding resistance.

SUMMARY OF THE INVENTION

The Spearhead anchor was conceived to achieve the three most important characteristics of an anchor:

instantaneous setting buries in all types of sea bed perfect holding without dragging

INSTANTANNEOUS SETTING

To dig in the sea bed, the pressure of the anchor's tip (Kilo/sq cm) must be higher than the seabed surface resistance. It is necessary:

(1) to reduce the contact surface: the tip must be as sharp as possible.

(2) To increase as much as possible the weight at the tip: the maximum weight distribution on the anchor tip is obtained through it's geometry and it's weight distribution. Due to it's geometry and balance, the anchor automatically positions itself in the setting position:

when the anchor is in the position to dig in, pulled by the anchor line, it stands on three points (a) the extremity of the shank (b) one of the two ears of the fluke (c) the tip of the anchor (FIG. 5). The ballast position constituting the counter-tip with a "chvron" cross section shape (FIG. 7), is external to the "tip/ear" axis (b–c) and located outside of the support base (a–b—c) to balance the weight of the shank (FIG. 5). At this time, nearly all the anchor's weight is distributed only between the two contact points: the tip (c) and one of the two ears (b). As a result, the anchor's centre of gravity is located nearly on the "tip/ear" axis (b–c) and as close as possible to the tip (c), in order to distribute the highest part of the weight onto the anchor's tip.

As most of the weight distribution is on the anchor tip, it improves the performance of digging into the sea bed

BURIES IN ANY TYPE OF SEA BED

In general, the density of the surface layer of the ea bed is not very high but increases as you go deeper down through the layers. On a mud or sand sea bottom, the pressure exerted by the tip, would be in the majority of cases, higher than the sea bottom resistance and the anchor's tip will dig in immediately. The boat pulling on the anchor will contribute to the anchor digging in.

Sea bottoms covered by a layer of thick weed make anchor penetration more difficult: most other common anchors tend to slip over the sea weed, without penetrating the bottom and can not hold. The Spearhead anchor, in the normal anchoring position, presents a profile with an angle of about 20° similar to a chisel (FIG. 7), this profile is applied to the sea bed at an angle of less than 90°, exactly like a chisel. Thus the anchor tends to penetrate beneath the weed, spreading it out, until it can reach solid bottom and dig in.

PROVIDE A HIGH HOLDING POWER

The density of the sea bed increases as you go deeper, therefore the anchor fluke must then be sharply pointed, with the tip down, so that the tip can provide the best penetration of the bottom. The widest part of the tip is connected to the lateral side of the quasi-elliptic shaped fluke. This provides the required surface area to ensure the holding power of the anchor even in the top layers of less density.

The geometry of the fluke is the second important factor in the anchor's holding power. A NACA profile (plane wing) has a holding resistance coefficient of 0.1, a "wedge" surface coefficient can range from 0.5 to 1 in relation to the wedge angle, a plane surface reaches a value of 1.20 and a concave surface coefficient will be 1.70. The working surface of the Spearhead anchor does have a concave shape which therefore gives the best holding power.

BRIEF DESCRIPTION OF THE DRAWING

The attached drawings illustrate the invention:

FIG. 5: Anchor assembly

DESCRIPTION OF THE PREFERRED EMBODIMENTS

Other objects, features and advantages will occurs from the following description of preferred embodiments in which:

The spearhead anchor is symmetrical about the fore-and-aft plane A A' (FIG. 4) and comprises a fluke (11) and a shank (1) attached to the fluke. Fluke (11) comprises a triangular shaped tip and a broad holding surface, both with a concave shape. The fluke is formed of either high resistance steel type P, 36.2; or manganese steel alloy; stainless steel type A 315.1, Marine grade quality; aluminum/magnesium alloy; or any material of equivalent strength.

The fluke is constructed with the tip folded to 140° around the central axis A A' (FIG. 4) and the back part including a concave region in it's upper surface.

Figures 1, 2, 3, 4:
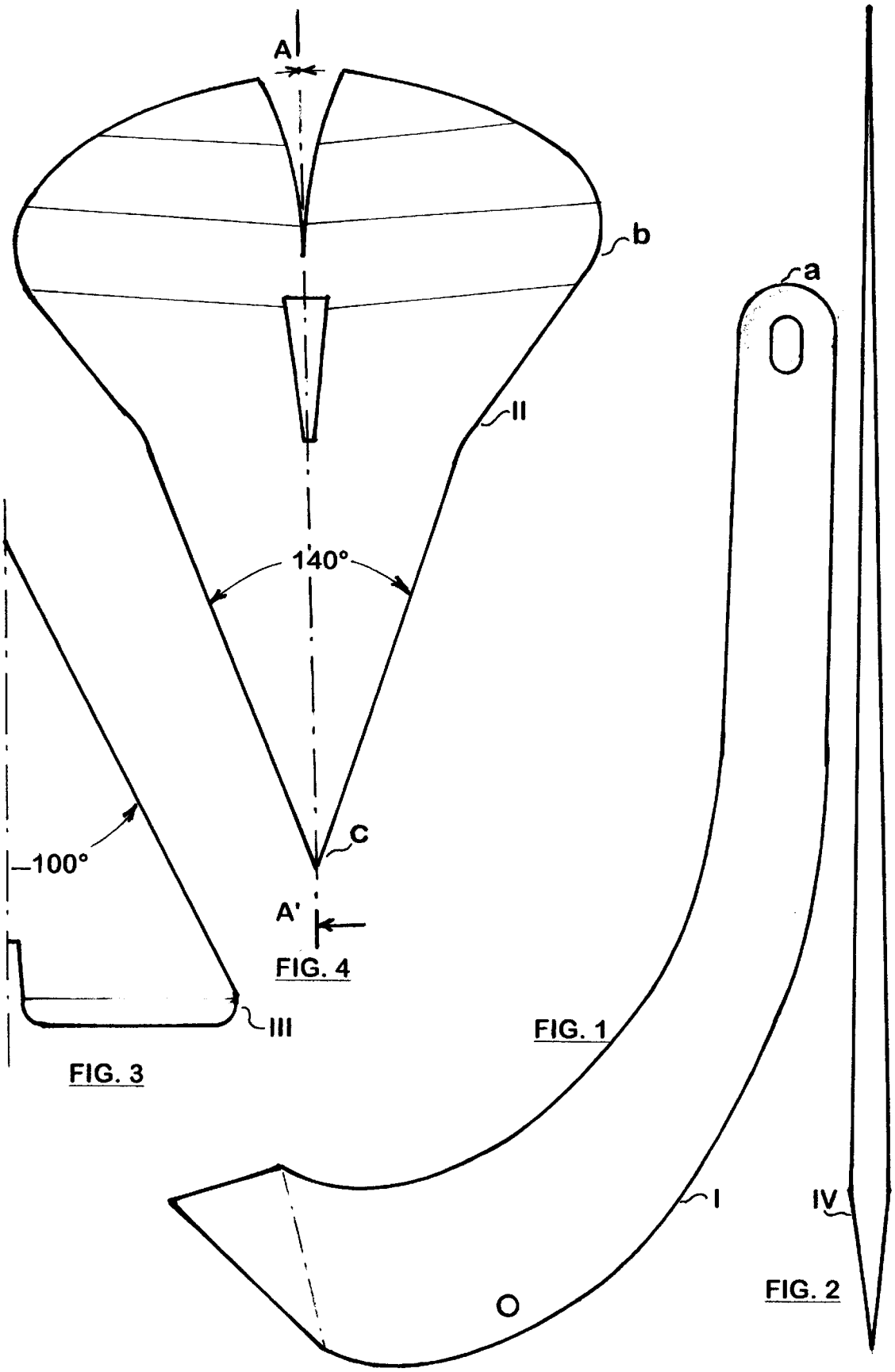
FIG. 1: Anchor shank seen from the side (2 identical parts)
FIG. 2: Top of the anchor shank, seen from the top (top view)
FIG. 3: Symmetrical half view of the anchor's underneath point part
FIG. 4: Fluke—top view

Below the spearhead shaped fluke (11—FIG. 4) an underneath counter-point part (111—FIG. 3) formed of the same material as the fluke is attached by electrical welding. The purpose of this counter-point is:

a) To reinforce the strength of the anchor tip, with a streamlined form folded to 100° (FIG. 3.

b) To create a cavity which will be filled with a heavy metal such as lead (FIG. 5).

When the anchor is in the position to dig in, lying on the sea bed, this ballast located behind the fluke point, external to the "tip/ear" axis (b—c FIG. 5), and thus located outside the support base (a–b–c FIG. 5), will precisely balance the weight of the shank (1). As a consequence, nearly all the anchor's weight is distributed between the two contact points: the tip (c) and the bottom "ear" (b). As a result, the anchor's centre of gravity is located nearly on the "tip/ear" axis and as close as possible to the anchor's tip. The highest possible proportion of the anchor's weight is expressed at the anchor's tip. The ballast could be made from either cast steel or cast lead The total weight will be scaled into different models starting at 6 Kg. to 40 Kg. to answer the requirements of yachts and coastal fishing boats. Heavier anchors can be manufactured for larger ships or industrial installations such as fishing farms or oil drilling platforms, etc. The anchor's five constituent parts will be cut by oxycutting, plasma cutting or any other appropriate means. The fluke angles and the counter part angle will be obtained through folding sheet meal of an appropriate thickness on a folding machine, or through embossing on a high pressure press or forging to obtain a perfectly concave shape of the fluke. For the largest sizes, the angulation can be obtained by cutting and welding the various parts to the required angle.

Figures 6, 7:
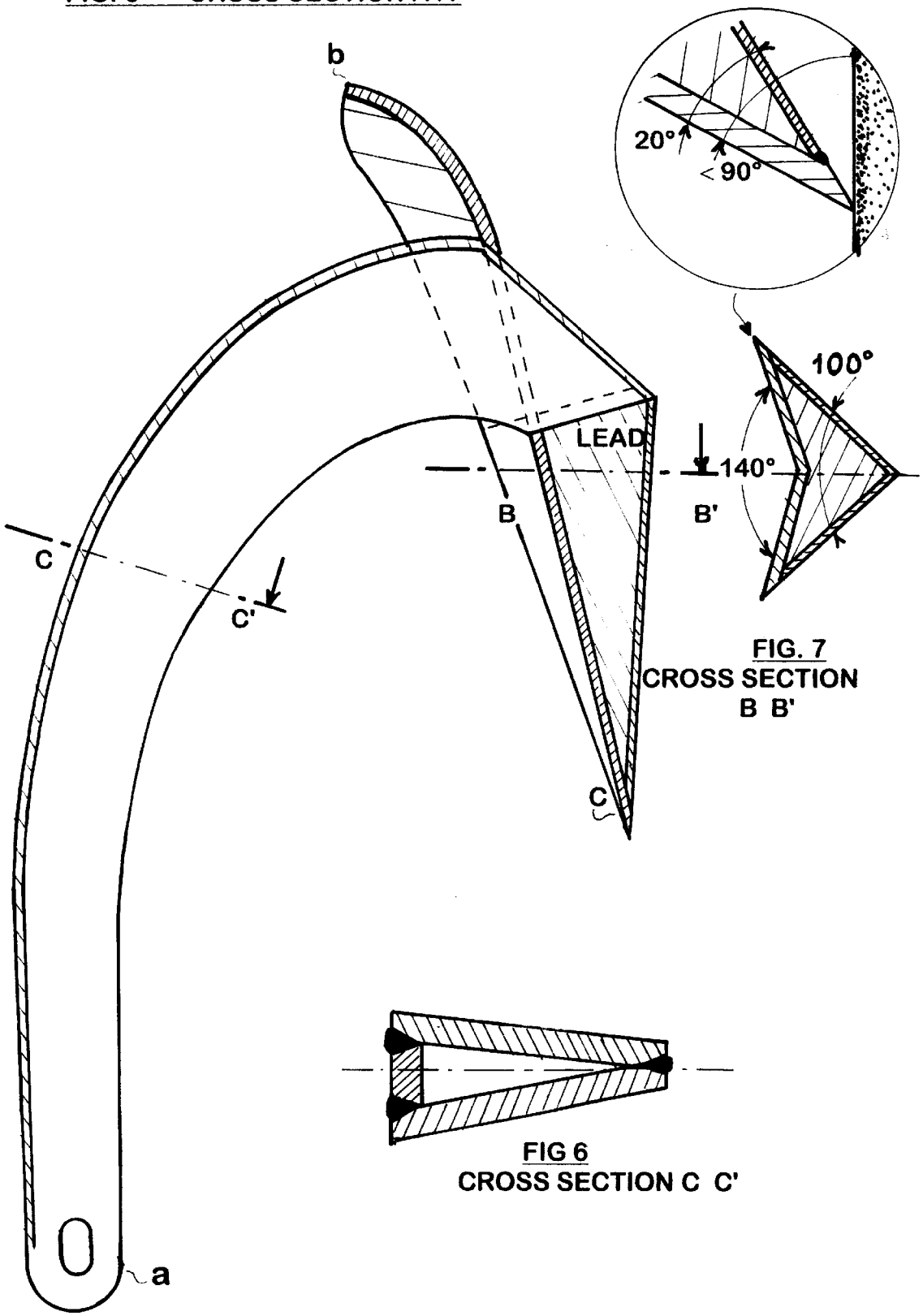
FIG. 6: Shank cross section—following cutting axis CC'
FIG. 7: Cross section of the anchor tip, "chevron shaped", cut following B B'

The angles of the smallest side of the trapezoidal shaped shank could be rounded or chamfered to facilitate penetration (FIG. 6).

After assembly by electrical welding, the steel anchor should be galvanised and then the necessary quantity of lead will be melted into the anchor tip (FIG. 5). In order to reduce fabrication costs, it would be possible to replace the lead ballast by a steel piece of the same shape obtained by casting, this part must be joined to the fluke and the heel of the shank by welding, to the shape of the cross section BB'

A variation of this anchor can be made with a dismantable shank providing easier storage of the anchor. This dismantable anchor can thus be used as a spare anchor.

I claim:

1. A boat anchor comprising a shank having a trapezoidal cross section welded to a fluke, said fluke comprising lower and upper parts and being symmetrical with respect to a vertical and longitudinal plane of symmetry, the fluke lower part being folded along the plane of symmetry at an angle of about 100°, the fluke upper part being folded along the plane of symmetry at an angle of about 140°, said upper and lower parts being welded together to form a tip of the anchor, such that a vertical transverse cross section of the anchor through said upper and lower parts exhibits generally a chevron shape, said upper and lower parts meeting at an angle of about 20°, a back part of said fluke having a quasi-elliptical shape with a concave surface and two projecting ears.

2. A boat anchor as set forth in claim 1 in which said shank is constituted by two lateral side parts and one upper part welded together to form said trapezoidal shape.

3. A boat anchor as set forth in claim 1 in which a volume is formed between said upper and lower parts of said fluke, said volume being filled with ballast, when said anchor is in a setting position, said ballast is located outside a support base formed by (a) the end of the shank remote from the fluke, (b) one of the two ears of the fluke, and (c) the tip of the anchor, and balances the weight of the shank thereby locating the center of gravity of the anchor close to the tip, thereby distributing the largest part of the total anchor's weight onto the tip.

4. A boat anchor as set forth in claim 1 in which in an anchoring position, said fluke is applied to the seabed at an angle of less than 90°.

5. A boat anchor as set forth in claim 3 in which said ballast comprises lead or a cast piece of steel.

6. A boat anchor as set forth in claim 1 in which the anchor is constructed of stainless steel, high resistance steel, manganese alloy, aluminum/magnesium alloy or any equivalent material.

* * * * *